United States Patent [19]

Vogel et al.

[11] Patent Number: 4,844,714

[45] Date of Patent: Jul. 4, 1989

[54] FUELS CONTAINING SMALL AMOUNTS OF ALKOXYLATES AND POLYCARBOXIMIDES

[75] Inventors: Hans-Henning Vogel, Frankenthal; Hans P. Rath, Gruenstadt; Knut Oppenlaender; Charalampos Gousetis, both of Ludwigshafen, all of Fed. Rep. of Germany

[73] Assignee: BASF Aktiengesellschaft, Ludwigshafen, Fed. Rep. of Germany

[21] Appl. No.: 164,492

[22] Filed: Mar. 4, 1988

[30] Foreign Application Priority Data

Mar. 14, 1987 [DE] Fed. Rep. of Germany ..... 3708538

[51] Int. Cl.[4] ..... C10L 1/14

[52] U.S. Cl. ..... 44/63; 44/57; 44/77

[58] Field of Search ..... 44/58, 63, 71, 62, 77, 44/68, 67, 57

[56] References Cited

U.S. PATENT DOCUMENTS

| | | | |
|---|---|---|---|
| 2,763,537 | 9/1956 | Barusch et al. | 44/57 |
| 2,841,479 | 7/1958 | Hefner et al. | 44/58 |
| 3,030,939 | 4/1962 | Brandt et al. | 44/77 |
| 3,838,992 | 10/1974 | Rosenwald | 44/72 |
| 3,901,665 | 8/1975 | Polss | 44/58 |
| 4,242,101 | 12/1980 | Vogel et al. | 44/63 |
| 4,548,616 | 10/1985 | Sung et al. | 44/77 |
| 4,659,338 | 4/1987 | Johnston et al. | 44/68 |

FOREIGN PATENT DOCUMENTS

| | | |
|---|---|---|
| 0006527 | 9/1981 | European Pat. Off. . |
| 0061895 | 3/1982 | European Pat. Off. . |
| 0110003 | 2/1983 | European Pat. Off. . |
| 2143846 | 7/1983 | United Kingdom . |

OTHER PUBLICATIONS

European Search Report EP 88 10 3420.

*Primary Examiner*—William R. Dixon, Jr.
*Assistant Examiner*—Margaret B. Medley
*Attorney, Agent, or Firm*—Keil & Weinkauf

[57] ABSTRACT

Fuels for gasoline engines and diesel engines contain small amounts (A) of an alkoxylate which is obtained by reacting ethylene oxide, propylene oxide or butylene oxide with a mono- or polyhydroxy compound and has a number average molecular weight (molecular mass) of from 500 to 6,000 and (B) of an imide or amidoimide, or a mixture of these, obtained from nitrilotriacetic acid and/or ethylenediaminetetraacetic acid and an amine of 7 to 18 carbon atoms, or a mixture of such amines, of the formula I

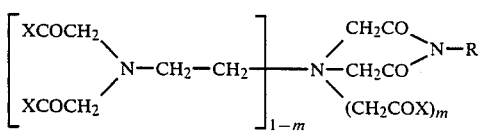

I where the radicals X are identical or different —HN—R radicals or adjacent radicals X are the radical >N—R and form a ring

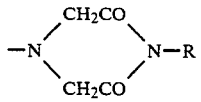

m is 0 or 1 and R is a straight-chain or branched aliphatic radical of 7 to 18 carbon atoms.

4 Claims, No Drawings

FUELS CONTAINING SMALL AMOUNTS OF ALKOXYLATES AND POLYCARBOXIMIDES

The present invention relates to fuels for gasoline engines and diesel engines, containing (a) small added amounts of alkoxylates, obtained by alkoxylation of mono- or polyhydroxy compounds, and (B) small added amounts of tri- or tetracarboxamides or -imides.

Carburettor and intake systems of gasoline engines, as well as injection systems for metering fuel in gasoline engines and diesel engines, are contaminated by impurities produced by dust particles from the air, unburned hydrocarbon residues from the combustion space and the vent gases from the crank case which have been passed back into the suction or intake system. By recycling these blow-by gases into the suction part or the air filter, some of the oil mist which is formed in the oil sump is reintroduced via the intake system into the engine and, for the most part, burned there; however, proportions of the oil mist are deposited in the internal spaces of the carburettor, in the intake ports, on the intake valves and at the injection jets. High performance carburettors are complicated structures having very fine channels and holes and precisely calibrated jets for spraying and metering the fuel.

The high performance injection units for gasoline engines and diesel engines are just as complicated and susceptible to deposition of dirt particles. If only small amounts of dirt and residues are deposited in these fine control elements, jets and channels, their ability to function is greatly affected and as a rule impaired. The consequence of this is an incorrect composition of the fuel-/air mixture, so that a fairly large proportion of unburned or partially burned hydrocarbons occur in the exhaust gases.

At the same time, the ratio of carbon monoxide to carbon dioxide in the exhaust gases is also adversely affected, ie. contaminated injection units or intake systems result in higher proportions of carbon monoxide in the exhaust gas.

To control these very undesirable phenomena, fuel additives have been added to the gasoline and diesel fuels for many years.

In the course of energy saving measures and for environmental reasons, there have also been constructive changes in fuel mixture preparation in modern high performance engines over the past few years. The aim of these measures was to minimize the proportion of carbon monoxide and burned hydrocarbons and of oxides of nitrogen in the exhaust gas. This was essentially achieved by changing the air/fuel mixture. Whereas in the past gasoline engines were operated essentially with the theoretical air requirement or slightly below this, ie. with $\lambda=0.9-1.0$, this situation has changed over the past few years. The characteristic $\lambda$ for the air/fuel mixture is now $\lambda=1.1-1.3$, ie. the gasoline engines are operated with a leaner fuel mixture. This is referred to as the lean concept.

These measures led to a substantial reduction in the proportion of carbon monoxide and partially burned hydrocarbons in the exhaust gas; however, for thermodynamic reasons, they unfortunately did not reduce the proportion of oxides of nitrogen ($NO_x$) in the exhaust gas but tended to increase the proportion of these oxides.

However, reduction of the $NO_x$ content or further reduction of carbon monoxide and partially burned hydrocarbons in the exhaust gas is possible by installation of exhaust catalysts. As a result of these measures, and due to the larger excess of air during fuel combustion, higher temperatures have occurred at the intake valves of the engines over the past few years, in some cases even substantially higher temperatures. This has made it necessary to develop fuel additives which possess substantially improved stability to thermal oxidation.

In addition to the altered concepts regarding preparation of the fuel mixture, the last few years have also seen a clear trend toward longer oil change intervals. The result of this has been that the performance of engine oils not only has to meet higher requirements but also has to be maintained over a longer time. These changes in engine oils have also helped to influence the requirements with regard to fuel additives. Because of the varying fuel content which is always present in the engine oils for constructional reasons (ie. fuel dilution), corresponding amounts of fuel additives also enter the oil. Depending on the method of driving and the state of the engine, fuel dilution is of the order of magnitude of from 0.5 to about 3%. Since engine oils are used in the engine over substantially longer periods and in particular at higher temperatures, the question of oil compatibility of fuel additives plays an important role.

It is an object of the present invention to provide fuel additives which have greater stability to heat and oxidation, keep the carburettor, the valves, the intake system or the injection jets clean and furthermore do not exhibit any undesirable side reactions in the engine or in the engine oil.

An important property of fuel additives, in addition to keeping the intake valves clean, is the retention of their basic mechanical function. Although carburettor and valve cleaners based solely on condensates of amines or polyamines with mono- or polycarboxylic acids have an excellent cleaning action, depending on the molecular structure they are deposited in the course of time in the form of a thin layer on the valve head and valve stem (valve guide) of the intake valves, owing to their high boiling point. Under certain driving conditions, and especially at low outside temperatures, the tacky layer may become so viscous that functioning of the valves is adversely affected. This may lead to compression losses in individual cylinders and, in unfavorable cases, to engine failure as a result of valves sticking.

Hence, advantageous fuel additives are those which, as a result of their cleaning effect, form completely desirable, thin protective films in the intake systems (valve head and valve stem); however, the viscosity of these protective films at low temperatures must not be too high or the protective films be too tacky so that engine failure occurs, ie. the intake valves remain sticking as a result of the very tacky valve stem.

It is a further object of the present invention to provide fuel additives and combinations of additives for gasoline and diesel fuels, which clean, or keep clean, both the carburettor and the intake valves, injection jets and the entire injection system but otherwise have no disadvantageous side effects in the sense described above.

We have found that this object is achieved by gasoline engine and diesel engine fuels which contain small amounts (A) of alkoxylates which are obtained by reacting ethylene oxide, propylene oxide or butylene oxide with a mono- or polyhydroxy compound and have a number average molecular weight (molecular mass) of from 500 to 6,000 and (B) of imides or amidoimides, or a mixture of these, obtained from nitrilotriacetic acid and/or ethylenediaminetetraacetic acid and an amine of 7 to 18 carbon atoms, or a mixture of such amines, of the formula I

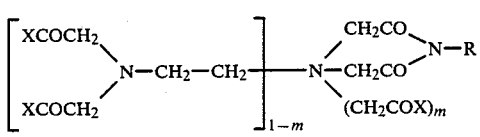

I where the radicals X are identical or different —HN—R radicals or adjacent radicals X are the radical

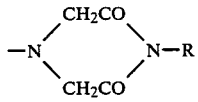

m is 0 or 1 and R is straight-chain or branched aliphatic radical of 7 to 18 carbon atoms.

The amount of the novel additives (A) and (B) added to gasoline and diesel fuels is from 0.01 to 0.3, preferably from 0.005 to 0.15, % by weight.

The weight ratio of components (A) and (B) is as a rule from 5:1 to 1:3.

Preferably used alkoxylates are butoxylates of mono- or polyhydroxy compounds and mixed alkoxylates obtained using propylene oxide/butylene oxide mixtures. The amount of butylene oxide or longer-chain alkylene oxide in the mixed alkoxlyate is responsible for the oil solubility and oil compatibility of the alkoxide. The weight ratio of proplyene oxide to butylene oxide can be from 5:95 to 95:5. Advantageous mixtures contain propylene oxide and butylene oxide in a ratio of from 60:40 to 30:70. In principle, all butylene oxides, ie. but-1-ene, but-2-ene or isobutene oxide, or any mixtures of these oxides with one another or with propylene oxide are suitable for the preparation of the novel alkoxylates. Effective alkoxylates are also obtained from mixtures of propylene oxide, butylene oxide and higher openchain and cyclic alkene oxides and from the higher openchain and cyclic alkene oxides alone.

Examples are pent-1-ene oxide, dec-1-ene oxide, cyclopentene oxide, cyclohexene oxide and cyclooctene oxide, as well as vinylcyclohexene oxides.

Suitable mono- or polyhydroxy compounds are alcohols of the general formula $R(OH)_n$ where n is from 1 to 4 and R is a straight-chain or, preferably branched $C_1$–$C_{20}$-alkane.

Typical examples are butanol, isobutanol, 2-ethylhexanol, isononanol, isodecanol, isotridecanol, ethylene glycol, 1,2-propylene glycol, propane-1,3-diol, 1,2-butylene glycol, butane-1,4-diol, pentane-1,5-diol, neopentyl glycol, hexane-1,6-diol, trimethylolpropane, butane-1,2,4-triol and pentaerythritol.

The alkoxylates are prepared by the prior art methods, ie. a mono- or polyhydroxy compound is initially taken as a starting material, together with the catalyst (eg. sodium hydroxide, potassium hydroxide or an alkali metal alcoholate), in a reactor and gassed with an alkylene oxide or a mixture of alkylene oxides or reacted with liquid alkylene oxides with stirring at from 120° to 150° C. When the reaction is complete, any unconverted gaseous alkylene oxide is removed under reduced pressure, and the crude alkoxylate is, if necessary, washed substantially alkali-free with water. For complete removal of the alkaline catalyst, for example where potassium hydroxide is used, the alkoxylate can be washed with a sufficient amount of an aqueous solution of sodium pyrophosphate ($Na_2H_2P_4O_7$). Sodium potassium pyrophosphate is precipitated as an insoluble double salt and can be filtered off.

For the alkoxylates to be used according to the invention, it is not necessary to use a mixture of the relevant alkylene oxides as a starting material in the case of mixed alkoxylates. It is also possible to react two or more alkylene oxides in succession with the mono- or polyhydroxy compound as the starting material. Furthermore, alkoxylates which are obtained by reacting mono- or polyhydroxy compounds initially only with a small amount of ethylene oxide (eg. 1–5 moles of ethylene oxide per hydroxyl group of the mono- or polyhydroxy compound) can be further converted to alkoxylates to be used according to the invention by subsequent reaction with an appropriate amount of higher alkylene oxides.

Examples of suitable components (B) are reaction products of nitrogen-containing polycarboxylic acids with mono-, oligo- or polyamines or industrial amine mixtures, as described, for example, as mixed components in EP-A-6527.

The compounds (B) of the formula I are obtained by a conventional method, for example by reacting nitrilotriacetic acid or ethylenediaminetetraacetic acid with an amine $R—NH_2$ or a mixture of such amines at from 150° to 220° C., as a rule from 160° to 200° C. Depending on the desired product, the amines are used in a molar ratio of 2:1 (cyclic diimide) or in an amount of 3 moles of amine or amine mixture per mole of ethylenediaminetetraacetic acid (aminoimide) or 2 moles per mole of nitriloacetic acid (amidoimide) or in slightly larger amounts. This in any case gives a predominant amount of amidoimides or imides, in addition to minor amounts of amides, ie. substitution of each carbonyl group by an amide radical.

Specifically, the following procedure is adopted: the amine or amine mixture is initially taken under a nitrogen atmosphere in a stirred vessel, the nitriloacetic acid or the ethylenediaminetetraacetic acid is introduced at about 80° C. and the stirred mixture is heated for from 4 to 10 hours at from 160° to 200° C. or, in the case of slowly reacting amines or amine mixtures, even at higher temperatures, until the acid number is less than 10.

Suitable amines of the formula $R—NH_2$ are those of 7 to 18, preferably 8 to 14, carbon atoms. These amines may possess further amino groups, for example nonprimary amino groups, or alkoxy groups. Oxygen atoms may also be present in the chain.

Specific examples of suitable amines, in which the alkyl radicals may be interrupted by nitrogen or oxygen atoms, are 2-ethylhexylamine, n-dodecylamine, n-tridecylamine, n-pentadecylamine, stearylamine, 2-amino-5-dimethylaminopentane and 1-(2-ethylhexyloxy)-prop-3-yl-amine.

In some cases, it has also proven advantageous to use amine mixtures.

Depending on the composition of the mixtures of the novel alkoxylates with the imides or amidoimides of EP-A-6527, it is possible completely or partly to dispense with the simultaneous use of highly hydrogenated oil distillates (ie. carrier oils) which are comparatively stable and hence less suitable for achieving the desired effect, such oil distillates being likewise described in EP-A-6527.

Fuel additives obtained using alkoxylates (A) and the polycarboximides may additionally contain a number of other known active components, such as stearically hindered substituted phenols as antioxidants, dipropylene glycol or similar glycols as antiicing additives for protecting the carburettor from icing, corrosion inhibitors, metal deactivators, demulsifiers and antistatic agents for increasing the conductivity of the fuels.

The efficiency of the combination to be used according to the invention is demonstrated below by various test methods, in comparison with the conventional commercial fuel additives.

TABLE 1

| Serial No. | Chemical composition or method of synthesis | Physical data for characterization | |
|---|---|---|---|
| | Composition of the additives and additive mixtures used | | |
| A | Alkoxylate of hexyl(di)-glycols + propylene oxide | Viscosity (40° C.) | 147 $mm^2/s$ |
| | | Viscosity (100° C.) | 23 $mm^2/s$ |
| | | Viscosity index | 185 |
| | | Density (20° C.) | 1.00 g/ml |
| | | Molecular weight (number average) | 2,000 |
| B | Alkoxylate of tridecanol and a 1:1 propylene oxide/1,2-butylene oxide mixture | Viscosity (40° C.) | 146 $mm^2/s$ |
| | | Viscosity (100° C.) | 22 $mm^2/s$ |
| | | Viscosity index | 178 |
| | | Density (20° C.) | 0.972 g/ml |
| | | Molecular weight (number average) | 2,200 |
| C | Alkoxylate of hexylglycol + propylene oxide | Viscosity (40° C.) | 460 $mm^2/s$ |
| | | Viscosity (100° C.) | 72 $mm^2/s$ |
| | | Viscosity index | 240 |
| | | Density (20° C.) | 1.00 g/ml |
| | | Molecular weight (number average) | 4,000 |
| D | Alkoxylate of trimethylolpropane and a 1:1 propylene oxide/1,2-butylene oxide mixture | Viscosity (40° C.) | 240 $mm^2/s$ |
| | | Viscosity (100° C.) | 30.8 $mm^2/s$ |
| | | Viscosity index | 170 |
| | | Density (20° C.) | 0.9877 g/ml |
| | | Molecular weight | 2,800 |
| E | Ethylenediaminetetraacetic acid reacted with monotridecylamine | According to EP-A 0006527 | |
| F | Ethylene diaminetetraacetic acid reacted with a 1:1 industrial amine mixture of mono- and ditridecylamine | According to EP-A 0006527 | |
| G | According to EP-A 0006527, Columns 7 and 8 Product B (lubricating oil mixture) | Viscosity (20° C.) | 24.2 $mm^2/s$ |
| | | Density (20° C.) | 0.852 g/ml |

The behaviour during driving, ie. in an engine operated on an engine test stand under conditions similar or identical to those used in practice, is critical with regard to the efficiency of fuel additives. For this purpose, the action of the novel combination was tested in a number of test engines. Testing the cleaning action in the Opel Kadett engine according to CEC method F-02-C 79.

The valve-cleaning action of additive-containing fuels is evaluated by this test method after 40 hours. The conditions for the method are summarized in the Table below.

| | | |
|---|---|---|
| Engine: | 4 cylinder engine, 1.2 l cubic capacity, 40 kW, carburettor 2 Solex PDSI | |
| Engine oil: | Reference oil RL 51 | |
| Running time: | 40 hours | |
| Test program per cycle: | | |
| Stage 1: | 30 s idling at 1,000 rpm | |
| Stage 2: | 1 min. at 3,000 rpm | 11.0 kW |
| Stage 3: | 1 min. at 1,300 rpm | 4.0 kW |
| Stage 4 | 2 min. at 1,850 rpm | 6.3 kW |
| Oil temperature in the oil sump | | 94 ± 2° C. |
| Coolant temperature (outlet) | | 92 ± 2° C. |
| Intake air temperature (idling) | | 100° C. |
| Carbon monoxide content in exhaust during idling | | 3.5 ± 0.5% by vol. |

The results are evaluated as follows. The new intake valves are cleaned and degreased with solvent and weighed accurately to three places after the decimal point before the test. When the test is complete, the valves are removed. First, the stems and the valve necks are evaluated by testing the tack by finger pressure. Thereafter, the valves, including the stems, are each rotated twice for 5 seconds in n-heptane and dried by waving them in the air. The valves are clamped at the stems in a horizontal drill, mechanically freed from the combustion residues adhering to the underneath of the neck by means of a wood splint or abrasive cloth of grade 400 at about 100–200 rpm and then reweighed accurately to three places after the decimal point. The deposits on all four valves are determined, and the result is stated in mg/valve.

The cleaning action in the carburettor is determined by evaluating the carburettor according to the CRC rating scale. Soiling of the carburettor in the case of additive-free fuels generally gives a rating of from 6.5 to 8.5. When effective carburettor-cleaning additives are present, the rating is from 8.0 to 10.0 at the end of the test. The rating 10.0 corresponds to a completely clean carburettor.

Table 2 contains test results for fuels without the use of fuel additives (Examples 1 to 3) and results of engine test runs employing the components of the combination to be used according to the invention.

TABLE 2

Examples: Testing additive-free fuels and individual active components
Test method: Opel Kadett test (CEC)

| Example No. | Additive according to Table 1 | Dose* (g/t) | Valve deposits (mg/valve) | Carburettor evaluation (CRC rating) |
|---|---|---|---|---|
| 1 | — | — | 390 | 7.5 |
| 2 | — | — | 458 | 7.2 |
| 3 | — | — | 292 | 7.8 |
| 4 | A | 500 | 166 | 8.0 |
| 5 | B | 500 | 105 | 8.5 |
| 6 | C | 500 | 132 | 8.2 |
| 7 | D | 500 | 148 | 8.2 |
| 8 | E | 300 | 27 | 9.0 |
| 9 | F | 300 | 41 | 9.0 |
| 10 | H | 1,000 | 184 | 7.8 |
| 11 | H | 500 | 242 | 7.8 |

*Dose of additives calculated as 100% active substance

In addition to the Opel Kadett engine, a Daimler Benz M 102 E engine was also used for testing the cleaning action in the intake system.

The test method is similar to that for the Opel Kadett test, the test conditions being summarized below:

Engine: 4 cylinder injection engine, 2.3 l cubic capacity, 100 kW
Engine oil: RL 51 or SAE 15W/40, API-SF/CC
Running time: from 40 to 150 hours
Test program per cycle:

| | | |
|---|---|---|
| Stage 1: | 30 s idling at 800 rpm | |
| Stage 2: | 1 min. at 3,000 rpm | 18.4 kW |
| Stage 3: | 1 min. at 1,300 rpm | 4.4 kW |
| Stage 4: | 2 min. at 1,750 rpm | 7.4 kW |
| Oil temperature in the oil sump | | 90 ± 3° C. |
| Coolant temperature (outlet) | | 89 ± 3° C. |
| Intake air temperature | | 30 ± 5° C. |

The valves are evaluated by the method used for the Opel Kadett engine. To make the test conditions more stringent, running times longer than 40 hours may also be chosen.

EXAMPLE 12 (Comparative Example)

Additive-free gasoline is tested (as a comparative test as also shown in Table 2, Examples 1, 2 and 3) in the Daimler Benz M 102 E engine too. It is found that, in the usual test runs over 40, 60, 80 or 150 hours with separate standard Daimler Benz M 102 E engines, fluctuating amounts of deposits are found on the intake valves. These fluctuations may be due to production-related fluctuations within the manufacturing tolerances for the engine. Furthermore, the amount of valve deposits in mg/ valve (as a mean value of 4 individual values for each test run) depends to a great extent on the condition (ie. on the total running time or the number of tests carried out previously).

Some results for valve deposits from additivefree fuels in the Daimler Benz M 102 E engine are shown in Table 3. Each test run is carried out for 40 h.

| Run | Engine condition, running time | Deposits mg/valve | |
|---|---|---|---|
| | Engine A and B | Engine A | Engine B |
| 1 | New condition* | 64 | 136 |
| 2 | after 200 h | 141 | 236 |
| 3 | after 500 h | 237 | 472 |
| 4 | after 1,000 h | 245 | 302 |
| 5 | after 2.000 h | 146 | 426 |
| | Engine C | | |
| 6 | Installed condition** | 273 | |
| 7 | after 80 h | 280 | |
| 8 | after 350 h | 424 | |
| 9 | after 1,000 h | 137 | |
| 10 | after 3,000 h | 125 | |
| 11 | after 5,000 h | 218 | |

*ex works
**The engine is used as a test engine after 12,000 km in a DB 230 E automobile

EXAMPLE 13 (Comparative Example)

The individual additives, A, B and E according to Table 2 are tested in an M 102 E test engine. Table 4 shows the results.

| Example test no. | Additives according to Table 1 | Dose* (g/t) | Valve deposits (mg/valve) |
|---|---|---|---|
| 13 a | A | 500 | 182** |
| b | B | 500 | 137** |
| c | E | 300 | 45 |

*Calculated as 100% active substance
**Determined in test engine B (cf. Table 3) after a total engine running time of about 800 h in a test run over 40 h

EXAMPLE 14

An additive mixture having the following composition is used:

24 parts by weight of component F in Table 1,
60 parts by weight of alkoxylate B in Table 1 and
16 parts by eight of a high boiling aromatic solvent (solvent naphtha which starts to boil at about 160° C. and predominantly consists of $C_9$+aromatics, eg. commercial products Solvesso 150 or Shellsol AB)

500 g/t of this mixture are added to a commercial leaded premium grade fuel (West German refinery product according to DIN 51,600), and the engine test run is carried out as prescribed in an Opel Kadett engine.

Result

| | |
|---|---|
| Valve deposit: | 0 mg/valve |
| Carburettor evaluation: | Rating 9.9 |

When only 350 g/t of the additive are metered in, 23 mg of deposit per valve and a carburettor rating of 9.6 are obtained.

EXAMPLE 15

The additive mixture used is the same as that stated in Example 14, except that it is tested in a test engine of the Daimler Benz M 102 E type. The additive doese is 800 g/t.

Result after running time of 40 hours

-continued

| | |
|---|---|
| Valve deposits: | 0 mg/valve |
| Results after running time of 150 hours | |
| Valve deposits: | 22 mg/valve |

EXAMPLE 16

An additive mixture of the following composition is used:

10 parts by weight of component F in Table 1,
25 parts by weight of alkoxylate B in Table 1 and
65 parts by weight of lubricant oil mixture G in Table 1.

600 g/t of this mixture are metered in as described in Example 14 and tested.

Result

| | |
|---|---|
| Valve deposits: | 18 mg/valve |
| Carburettor evaluation | 9.2 |

When 800 g/t are metered in, the valve deposits are 0 mg/valve and the carburettor rating is 9.4.

EXAMPLE 17

An additive mixture of the following composition is used:

25 parts by weight of component E in Table 1,
60 parts by weight of alkoxylate B in Table 1,
10 parts by weight of dipropylene glycol and
5 parts by weight of solvent naphtha according to Example 17

800 g/t of this mixture are metered into the test fuel and tested in a Daimler Benz M 102 E engine.

Result after running time of 40 hours:
valve deposits 0 mg/valve

EXAMPLE 18

When the additive mixture according to Example 17 is used but component E in Table 1 is replaced with the same amount of component F, the following results are obtained:

Valve deposits less than 3 mg/valve.

Testing the valve tack in the intake valve of a 4 cylinder engine, type Opel Ascona, cubic capacity 1.6 l, 66 kW The engine is operated according to the same test cycle as that described for the Daimler Benz M 102 E engine. The cleaning action in the inlet valves is evaluated after 40, 80, 120 or 200 hours, evaluation being effected in the same manner as for the Opel Kadett and Daimler Benz engines.

The valve tack is checked visually. For this purpose, the cylinder head is removed and then placed in an inclined position at about 45°-60°, with the intake valves still inside. In the case of additive-free fuels, where absolutely no sticking of the valves is observed, the intake valves slip out of the valve guide in a very short time under their own weight. Valves which stick as a result of unsuitable fuel additives can be detected from the fact that the intake valves do not slip out of the guide under their own weight and can only be moved out by mechanical means.

In evaluating the valve movement, a distinction is made between four stages:

Stage 1: Valves slide out freely in the course of from 5 to 10 s.

Stage 2: Valves slide out gradually, taking more than 30 s.

Stage 3: Valves do not slide out but can be pulled out manually.

Stage 4: Valves stick so firmly that they can no longer be pulled out manually.

EXAMPLE 19

Test runs to test valve tack are carried out in a 1.6 l engine of the Opel Ascona type. All tests are performed for a period of 200 hours. This corresponds to a fuel consumption of about 2,000 l and a distance of about 4,000–5,000 km. The results are shown in Table 4.

TABLE 4

| Test No. | Additive | Dose (g/t) | Valve tack (stage) | Comments |
|---|---|---|---|---|
| 1 | No additive | — | 1 | — |
| 2 | E, Table 1 | 300 | 3 | |
| 3 | E, Table 1 | 600 | 4 | |
| 4 | F, Table 1 | 300 | 3–4 | |
| 5 | F, Table 1 | 600 | 4 | |
| 6 | Mixture of 60 parts by weight of E, Table 1, and 40 parts by weight of G, Table 1 | 800 | 3–4 | Comparative Example |
| 7 | 60 parts by weight of E, Table 1, and 40 parts by weight of B, Table 1 | 800 | 1 | |
| 8 | Example 14 | 500 | 1 | |
| 9 | Example 14 | 800 | 1 | |

Test conditions for testing the valve tack in a driving test in practice

| | |
|---|---|
| Engine: | Volkswagen, Boxer engine, 1.9 l cubic capacity, 44 kW |
| Driving program: | 10 km at maximum speed of 50 km/h<br>10 km at maximum speed of 60 km/h<br>10 min at rest |

According to this program under changing conditions, a total of 130 km per day is driven. The vehicle is placed in the open overnight. Next morning, the following tasks are carried out and the behavior of the vehicle described:

Test compression

Visually evaluate the intake valves and the valve stems using an endoscope through the spark plug orifices Start attempt (e)

The tests summarized in the Table below are carried out in accordance with the above test program. All tests are performed using the same commercial premium grade leaded fuel from a West German refinery.

In all tests, the outside temperature while the vehicle is parked during the night is between +3° and −3° C. The temperatures in the engine space before the measurement next morning are between +3° and +8° C.

TABLE 5

| Test No. | Additive mixture | Dose (g/t) | Evaluation at end of test | Comments |
|---|---|---|---|---|
| 1 | No additive | — | No compression losses<br>Vehicle starts immediately | Comp. test |
| 2 | E, Table 1 | 300 | Valve stems tacky | Comp |

TABLE 5-continued

| Test No. | Additive mixture | Dose (g/t) | Evaluation at end of test | Comments |
|---|---|---|---|---|
| | | | Valves on cylinders 1 and 3 stick Engine cannot be started | test |
| 3 | F, Table 1 | 300 | Valve stems slightly tacky. Engine starts after 5 attempts | Comp. test |
| 4 | Example 4 | 800 | Valve stems not tacky. Engine starts immediately | |

We claim:

1. A fuel for gasoline and diesel engines, containing 0.005 to 0.3% by weight, calculated on the sum of (A) and (B) of (A) an alkoxylate which is obtained by reacting (a) butylene oxide or (b) butylene and propylene oxide in the ratio from 5:95 to 95:5 by weight with a mono- or polyhydroxy compound, such alkoxylate having a number average molecular weight (molecular mass) of from 500 to 6,000; and (B) of an imide or amidoimide, or a mixture of these, obtained from nitrilotriacetic acid and/or ethylenediaminetetracetic acid and an amine of 7 to 18 carbon atoms, or a mixture of such amines, of the formula I

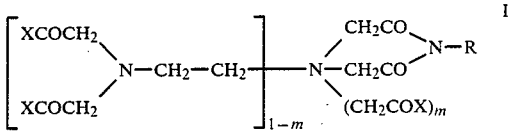

I where the radicals X are identical or different —HN—R radicals or adjacent radicals X are the radical

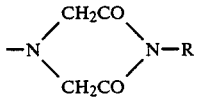

m is 0 to 1 and R is a straight-chain or branched aliphatic radical of 7 to 18 carbon atoms, the weight ratio of components (A) and (B), being 5:1 to 1:3.

2. A fuel as defined in claim 1, wherein an alkoxylate of a mono- or polyhydroxy compound of the formula $R(OH)_n$ where n is from 1 to 4 and R is a straight-chain or branched $C_1$–$C_{20}$-alkane, is used as component (A).

3. A fuel as defined in claim 2, wherein a butoxylate is used as component (A).

4. A fuel as defined in claim 1, which contains from 0.01 to 0.3% by weight, based on the sum of components (A) and (B).

* * * * *